US007934816B2

(12) United States Patent
Tsukahara et al.

(10) Patent No.: US 7,934,816 B2
(45) Date of Patent: May 3, 2011

(54) METHOD OF FILLING LIQUID INTO LIQUID CONTAINING MEMBER, LIQUID FILLING APPARATUS AND METHOD OF INSPECTING LIQUID CONTAINING MEMBER

(75) Inventors: Michinari Tsukahara, Nagano-ken (JP); Masanori Kobayashi, Nagano-ken (JP); Morio Sato, Nagano-ken (JP); Kenji Ochiai, Nagano-ken (JP); Yasuto Sakai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 475 days.

(21) Appl. No.: 11/559,187

(22) Filed: Nov. 13, 2006

(65) Prior Publication Data

US 2007/0091129 A1 Apr. 26, 2007

Related U.S. Application Data

(63) Continuation of application No. 10/958,037, filed on Oct. 4, 2004, now Pat. No. 7,357,498.

(30) Foreign Application Priority Data

Dec. 24, 2003 (JP) ..... P2003-428219
Dec. 24, 2003 (JP) ..... P2003-428221

(51) Int. Cl.
*B41J 2/175* (2006.01)

(52) U.S. Cl. ..... 347/85; 347/86

(58) Field of Classification Search ..... 347/86, 347/85

See application file for complete search history.

(56) References Cited

U.S. PATENT DOCUMENTS

| | | | | |
|---|---|---|---|---|
| 4,865,060 | A | 9/1989 | Shibano | |
| 4,928,126 | A * | 5/1990 | Asai | 347/86 |
| 5,033,287 | A | 7/1991 | Watanabe et al. | |
| 5,691,753 | A * | 11/1997 | Hilton | 347/85 |
| 5,950,403 | A | 9/1999 | Yamaguchi et al. | |
| 5,971,531 | A * | 10/1999 | Dietl et al. | 347/86 |
| 6,003,635 | A * | 12/1999 | Bantz et al. | 184/1.5 |
| 6,036,296 | A * | 3/2000 | Axtell et al. | 347/7 |
| 6,224,198 | B1 * | 5/2001 | Cook et al. | 347/85 |
| 6,224,199 | B1 | 5/2001 | Yamaguchi et al. | |

(Continued)

FOREIGN PATENT DOCUMENTS

| | | |
|---|---|---|
| CN | 1214012 A | 4/1999 |
| CN | 1090097 C | 9/2002 |
| JP | 60-027833 A | 2/1985 |

(Continued)

*Primary Examiner* — Stephen D Meier
*Assistant Examiner* — Sarah Al-Hashimi
(74) *Attorney, Agent, or Firm* — Stroock & Stroock & Lavan LLP

(57) ABSTRACT

When ink is filled into an ink pack 13 including a bag part 20 and an outlet part 21, firstly, air in the bag 20 and outlet part 21 is sucked by a suction pump P2 provided for an ink pouring apparatus 30. Further, by a first measuring pipe 43, ink supplied from a main tank 31 is poured through the outlet part 21 into the bag part 20. Further, by a second measuring pipe 52, the ink poured into the bag part 20 of the ink pack 13 is sucked and exhausted. Furthermore, the ink in the second measuring pipe 52 is mixed into a mixing tank 34 with ink previously supplied to the mixing tank 34 from the main tank 31. Next, the ink is supplied from the mixing tank 34 to a third measuring pipe 59, and filled from the third measuring pipe 59 through the outlet part 21 into the bag part 20.

3 Claims, 5 Drawing Sheets

U.S. PATENT DOCUMENTS

| | | | | |
|---|---|---|---|---|
| 6,281,909 | B1 | 8/2001 | Fassler et al. | |
| 6,289,654 | B1 | 9/2001 | Yamaguchi et al. | |
| 6,302,516 | B1 | 10/2001 | Brooks et al. | |
| 6,460,967 | B1 | 10/2002 | Makita et al. | |
| 6,471,343 | B1 * | 10/2002 | Shimizu et al. | 347/85 |
| 6,485,137 | B2 * | 11/2002 | Karlinski et al. | 347/92 |
| 7,393,089 | B2 | 7/2008 | Yamaguchi et al. | |
| 2002/0158954 | A1 * | 10/2002 | Usui et al. | 347/104 |
| 2003/0107627 | A1 * | 6/2003 | Seino et al. | 347/86 |

FOREIGN PATENT DOCUMENTS

| | | | | |
|---|---|---|---|---|
| JP | 63-009546 | A | | 1/1988 |
| JP | 01-316626 | A | | 12/1989 |
| JP | 04155173 | A | * | 5/1992 |
| JP | 11104482 | A | * | 4/1999 |
| JP | 2000-072101 | A | | 3/2000 |
| JP | 2003-053984 | | | 2/2003 |
| JP | 2003-127409 | | | 5/2003 |
| JP | 2004-045289 | A | | 2/2004 |

* cited by examiner

METHOD OF FILLING LIQUID INTO LIQUID CONTAINING MEMBER, LIQUID FILLING APPARATUS AND METHOD OF INSPECTING LIQUID CONTAINING MEMBER

CROSS-REFERENCE TO RELATED APPLICATION

This application is a division of copending application Ser. No. 10/958,037, filed on Oct. 4, 2004.

BACKGROUND OF THE INVENTION

The present invention relates to a method of filling liquid into a liquid containing member, and a liquid filling apparatus. The invention also relates to a method of inspecting a liquid containing member.

As a liquid jet apparatus which jets liquid to a target, an ink jet type recording apparatus has been used widely. Specifically, this ink jet type recording apparatus includes a carriage, a recording head mounted on the carriage and functioning as a liquid jet head, and an ink cartridge used as a liquid containing member which contains ink as liquid therein. While the carriage is being moved in relation to a recording medium, the ink is supplied from the ink cartridge to the recording head, and the ink is ejected from a nozzle formed in the recording head, whereby printing is performed on the recording medium of the target.

In such the ink jet type recording apparatuses, there is an apparatus in which an ink cartridge is not mounted on a carriage in order to reduce load onto the carriage or to reduce size/thickness of the apparatus (so-called Off-carriage type). An ink cartridge applied to such the printer includes usually an ink pack used as a bag-shaped liquid containing part which contains ink therein, and a case which houses the ink pack. The ink in the ink pack is supplied to a recording head through an ink supply tube (refer to, for example, JP-A-2003-53984).

This ink pack is made of a bag-shaped film, and has a bag part provided with a communication part. After ink has been filled into the bag part from an opening part of the bag part, the opening part is heat-welded, whereby the bag part is sealed hermetically. At this time, into the bag part, the ink must be filled in a state where clean and degassed levels are high. Further, in case that a poorly welded portion exists in the ink pack, ink leaks from its portion. Moreover, in case that damage such as a minute pore exists in the flexible film itself, there is fear that the ink leaks from its damage portion.

An inspection method of confirming the presence or absence of leak in an ink flowing passage has been proposed (refer to, for example, JP-A-2003-127409). In this inspection method, a leak tester is connected to the ink cartridge, and air is pressure-fed into the ink cartridge. Thereafter, the outflow of air leaking from the ink cartridge is measured by the leak tester, whereby the presence or absence of the leak is confirmed.

However, in the above inspection method, the ink pack (ink cartridge) must be connected to the leak tester one by one for inspection, and it takes much labor for inspection.

Under these circumstances, an object of the invention is to provide a method of filling liquid into a liquid containing member in which liquid having high degassed and clean levels can be filled, and a liquid filling apparatus.

Another object of the invention is to provide a method of filling liquid into a liquid containing member in which liquid is used efficiently and liquid having high degassed and clean levels can be filled, and a liquid filling apparatus.

Yet another object of the invention is to provide a method of inspecting a liquid containing member, which can perform inspection easily.

SUMMARY OF THE INVENTION

The present invention provides a method of filling liquid into a liquid containing member, which method has a step of cleaning the inside of the liquid containing member using the liquid.

In this method, before the liquid is filled into the liquid containing member, a predetermined amount of the liquid is poured into the liquid containing member to cause the poured liquid to entrap air/dust remaining in the bag part. Thereafter, its liquid is exhausted, whereby the air/dust in the liquid containing member is exhausted, and the degassed and clean levels in the liquid containing member can be heightened.

The present invention also provides, as a preferable example, a method of filling liquid of the invention into a liquid containing member provided with a liquid containing part which can contain liquid therein, and a communication part which communicates the inside and the outside of the liquid containing part, comprises the steps of: sucking gas inside the liquid containing part through the communication part by a first suction means; pouring, by a liquid pouring means, liquid supplied from a liquid storing means which stores liquid therein, as cleaning liquid, through the communication part into the liquid containing part; sucking the cleaning liquid poured into the liquid containing part through the communication part by a second suction means; mixing the cleaning liquid sucked by the second suction means and the liquid supplied from the liquid storing means by a mixing means; and pouring the liquid mixed by the mixing means into the liquid containing part by the liquid pouring means.

According to this method, when the liquid containing member is manufactured, the liquid supplied from the liquid storing means is poured into the liquid containing part depressurized by the first suction means, and the poured liquid is sucked by the second suction means. Hereby, dust and air in the liquid containing part and the communication part can be exhausted together with the liquid. Further, the sucked liquid is mixed with the liquid supplied from the liquid storing means by the mixing means, and the mixed liquid is poured into the liquid containing part by the liquid pouring means. Therefore, the sucked liquid is not thrown away but can be used as liquid to be filled into the liquid containing member. In result, degassed and clean levels in the liquid containing member can be improved, and the liquid can be efficiently used in the process of manufacturing the liquid containing member.

In this method of filling liquid into the liquid containing member, the mixing means is provided with a mixing tank connected to the second suction means, the liquid storing means, and the liquid pouring means; and the mixing tank mixes the cleaning liquid supplied from the second suction means and the liquid supplied from the liquid storing means, and supplies the mixed liquid to the liquid pouring means.

Accordingly, the mixing means is provided with the mixing tank, mixes the liquid supplied from the second suction means and the liquid supplied from the liquid storing means, and supplies the mixed liquid to the liquid pouring means. Therefore, the liquid entrapping dust and gas in the liquid containing member and sucked by the second suction means is not poured into the liquid storing means but is used in order to be immediately filled into the liquid containing member. Accordingly, since the liquid that has circulated many times in the apparatus is not used, liquid that is always new and has quality assurance can be filled into the liquid containing member.

In this method of filling liquid into the liquid containing member, the cleaning liquid sucked from the liquid containing part by the second suction means, before passing through the mixing means, is filtered by a filter, or the mixed liquid after passing through the mixing means is filtered by a filter.

Accordingly, the liquid sucked by the second suction means is filtered by the filter, and drawn to the mixing means or the liquid pouring means. Accordingly, the liquid entrapping the dust and gas in the liquid containing member, in a state where the degassed and clean levels are improved, can be drawn to the mixing means or the liquid pouring means. Therefore, the liquid having high quality can be filled into the liquid containing member.

In this method of filling liquid into the liquid containing member, in the step of pouring the cleaning liquid supplied from the liquid storing means into the liquid containing part, a first predetermined amount of liquid is poured by the liquid pouring means; in the step of pouring the liquid mixed by the mixing means into the liquid containing part, a second predetermined amount of liquid is poured by the liquid pouring means; and the first predetermined amount is smaller than the second predetermined amount.

Accordingly, the first predetermined amount of liquid poured into the liquid containing member by the liquid pouring means is smaller than the second predetermined amount of liquid actually filled into the liquid containing member. Therefore, the liquid exhausted from the liquid containing member and reused can be reduced, so that quality of the liquid filled into the liquid containing member can be improved.

In this method of filling liquid into the liquid containing member, in the step of pouring the cleaning liquid into the liquid containing part by the liquid pouring means, liquid degassed by a degassing means is poured into the liquid containing part.

Accordingly, when liquid is poured into the liquid containing member from the liquid storing means, liquid degassed by the degassing means is poured. Namely, since the liquid previously degassed is poured into the liquid containing member, stain in the liquid containing member and inclusion of air bubbles can be prevented.

In this method of filling liquid into the liquid containing member, in the step of pouring the liquid mixed by the mixing means into the liquid containing part by the liquid pouring means, liquid degassed by a degassing means is poured into the liquid containing part.

Accordingly, after the liquid mixed by the mixing means has been degassed by the degassing means, it is poured into the liquid containing part. Therefore, the liquid having higher degassed level can be filled into the liquid containing member.

The present invention also provides, as a preferable example, an apparatus of filling liquid of the invention into a liquid containing member provided with a liquid containing part which can contain liquid, and a communication part which communicates the inside and the outside of the liquid containing part, comprises: a liquid storing means which stores liquid therein; a first suction means which sucks gas in the liquid containing part through the communication part; a liquid pouring means which is connected to the liquid storing means and pours the supplied liquid from the communication part into the liquid containing part; a second suction means which sucks, through the communication part, cleaning liquid supplied from the liquid storing means and poured into the liquid containing part by the liquid pouring means; and a mixing means which mixes the cleaning liquid sucked by the second suction means and the liquid supplied from the liquid storing means, and supplies the mixed liquid to the liquid pouring means.

Accordingly, in the apparatus of filling liquid into the liquid containing member, the liquid supplied from the liquid storing means is poured into the liquid containing part depressurized by the first suction means, and the poured liquid is sucked by the second suction means. Hereby, the dust and air in the liquid containing part and the communication part can be exhausted together with the liquid. Further, the sucked liquid is mixed with the liquid in the liquid storing means by the mixing means, and the mixed liquid is poured into the liquid containing part by the liquid pouring means. Therefore, the sucked liquid is not thrown away but can be used as liquid to be filled into the liquid containing member. In result, the degassed and clean levels in the liquid containing member can be improved, and the liquid can be efficiently used in the process of manufacturing the liquid containing member.

In this apparatus of filling liquid into the liquid containing member, the mixing means is provided with a mixing tank, and the mixing tank is connected to the second suction means and the liquid storing means, receives the supplied liquid, and supplies the liquid to the liquid pouring means.

Accordingly, the mixing means is provided with the mixing tank, mixes the liquid supplied from the second suction means and the liquid supplied from the liquid storing means, and supplies the mixed liquid to the liquid pouring means. Therefore, the liquid that entraps the dust and gas into the liquid containing member and is sucked by the second suction means is not mixed with the liquid stored into the liquid storing means, but is used in order to be immediately filled into the liquid containing member. Accordingly, since the liquid that has circulated many times in the apparatus is not used, liquid that is always new and has quality assurance can be filled into the liquid containing member.

In this apparatus of filling liquid into the liquid containing member, a filter is provided in the middle of a first supply passage connecting the second suction means and the mixing tank, or in the middle of a flowing passage connecting the mixing means and the liquid pouring means.

Accordingly, the liquid sucked by the second suction means is filtered by the filter provided in the middle of the first supply passage, or in the middle of the flowing passage connecting the mixing means and the liquid pouring means, and drawn to the mixing means or the liquid pouring means. Accordingly, the liquid entrapping the dust and gas in the liquid containing member, in a state where the degassed and clean levels are improved, can be drawn to the mixing means or the liquid pouring means. Therefore, the liquid having high quality can be filled into the liquid containing member.

In this apparatus of filling liquid into the liquid containing member, the liquid pouring means includes a first liquid pouring means which draws a first predetermined amount of liquid, and a second liquid pouring means which draws a second predetermined amount of liquid that is larger than the first predetermined amount of liquid; the first liquid pouring means pours the cleaning liquid supplied from the liquid storing means into the liquid containing part; and the second liquid pouring means pours the liquid mixed by the mixing means into the liquid containing part.

Accordingly, the liquid filling apparatus includes the first liquid pouring means which draws the first predetermined amount of liquid, and the second liquid pouring means which draws the second predetermined amount of liquid. Further, the first predetermined amount of liquid is smaller than the second predetermined amount of liquid to be filled into the liquid containing part. Therefore, the liquid exhausted from the liquid containing member and reused can be reduced, so that quality of the liquid filled into the liquid containing member can be improved.

In this apparatus of filling liquid into the liquid containing member, a degassing means for degassing liquid is provided in the middle of a first liquid supplying passage connecting the liquid storing means and the communication part of the liquid containing member.

Hereby, when the liquid is poured into the liquid containing member from the liquid storing means, the liquid degassed by the degassing means is poured. Namely, since the liquid previously degassed is poured into the liquid containing member, stain in the liquid containing member and inclusion of air bubbles can be prevented.

In this apparatus of filling liquid into the liquid containing member, a degassing means for degassing liquid is provided in the middle of a second liquid supplying passage connecting the mixing means and the communication part.

Hereby, after the liquid mixed by the mixing means has been degassed by the degassing means, it is poured into the liquid containing part. Therefore, liquid having higher degassed level can be filled into the liquid containing member.

The present invention further provides a method of inspecting a liquid containing member provided with a liquid containing part that is at least in part formed by a flexible member and can contain liquid therein, and a communication part that communicates the inside of the liquid containing part with the outside, comprises the steps of: causing the flexible member of the liquid containing part to yield by setting the internal pressure of the liquid containing part to a predetermined pressure that is different from the external pressure of the liquid containing part by a pressure variable means; and judging whether the flexible member is kept in a yielding state after the liquid containing part has been left for a predetermined time.

Accordingly, in a stat where the difference is provided between the internal pressure of the liquid containing part and the external pressure, the flexible member of the liquid containing part is caused to yield. Further, after the predetermined time, whether the flexible member is kept in the yielding state is judged, whereby presence or absence of leak can be confirmed. Therefore, by only confirming whether the flexible member is kept in the yielding state, the inspection is performed, so that labor for inspection can be omitted, and the inspection can be easily performed.

In this method of inspecting a liquid containing member, in the step of setting the internal pressure of the liquid containing part to the predetermined pressure by the pressure variable means, the internal pressure of the liquid containing part is set to pressure lower than the external pressure.

Accordingly, in the step of setting the internal pressure of the liquid containing part to the predetermined pressure, the internal pressure is set lower than the external pressure. Accordingly, in case that the structure of the liquid containing part is comparatively fragile, since, without increasing the internal pressure of the liquid containing part, the presence or absence of leak can be judged, it is possible to prevent the liquid containing part from breaking by increasing the internal pressure of the liquid containing part.

In this method of inspecting a liquid containing member, in the step of setting the internal pressure of the liquid containing part to the predetermined pressure by the pressure variable means, the internal pressure of the liquid containing part is set to pressure higher than the external pressure.

Accordingly, in the step of setting the internal pressure of the liquid containing part to the predetermined pressure, the internal pressure is set higher than the external pressure. Therefore, in case that it is desired that a comparatively large amount of liquid is filled into the liquid containing part, the presence or absence of leak can be inspected according to its condition.

In this method of inspecting a liquid containing bag, the liquid containing part is formed in the shape of a bag by heat-welding edges of the flexible members.

Accordingly, the internal pressure of the bag-shaped liquid containing part by heat-welding is set lower than the external pressure thereby to perform inspection. Therefore, the comparatively fragile liquid containing part, without damaging the heat-welded part, can be inspected.

In this method of inspecting a liquid containing member, for the communication part of the liquid containing bag, a valve mechanism is provided, which opens when a connection member of the pressure variable means is inserted into the communication part, and closes when the connection member is pulled out from the communication part; and when the internal pressure of the liquid containing part is set to the predetermined pressure, the connection member is inserted into the communication part to communicate the pressure variable means with the inside of the liquid containing part, and when the liquid containing part is left for a predetermined time, the connection member is pulled out from the communication part.

Accordingly, for the communication part of the liquid containing member, the valve mechanism is provided, which opens when the connection member of the pressure variable means is inserted into the communication part, and closes when the connection member is pulled out from the communication part. Therefore, when the inside of the liquid containing part comes to the predetermined pressure, the connection member is pulled out and the valve mechanism is closed, whereby inflow or outflow of the fluid through the communication part can be shut off.

The present disclosure relates to the subject matter contained in Japanese patent application Nos. 2003-428221 (filed on Dec. 24, 2003) and 2003-428219 (filed on Dec. 24, 2004), each of which is expressly incorporated herein by reference in its entirety.

DESCRIPTION OF THE PREFERRED EMBODIMENT

Figure 1:
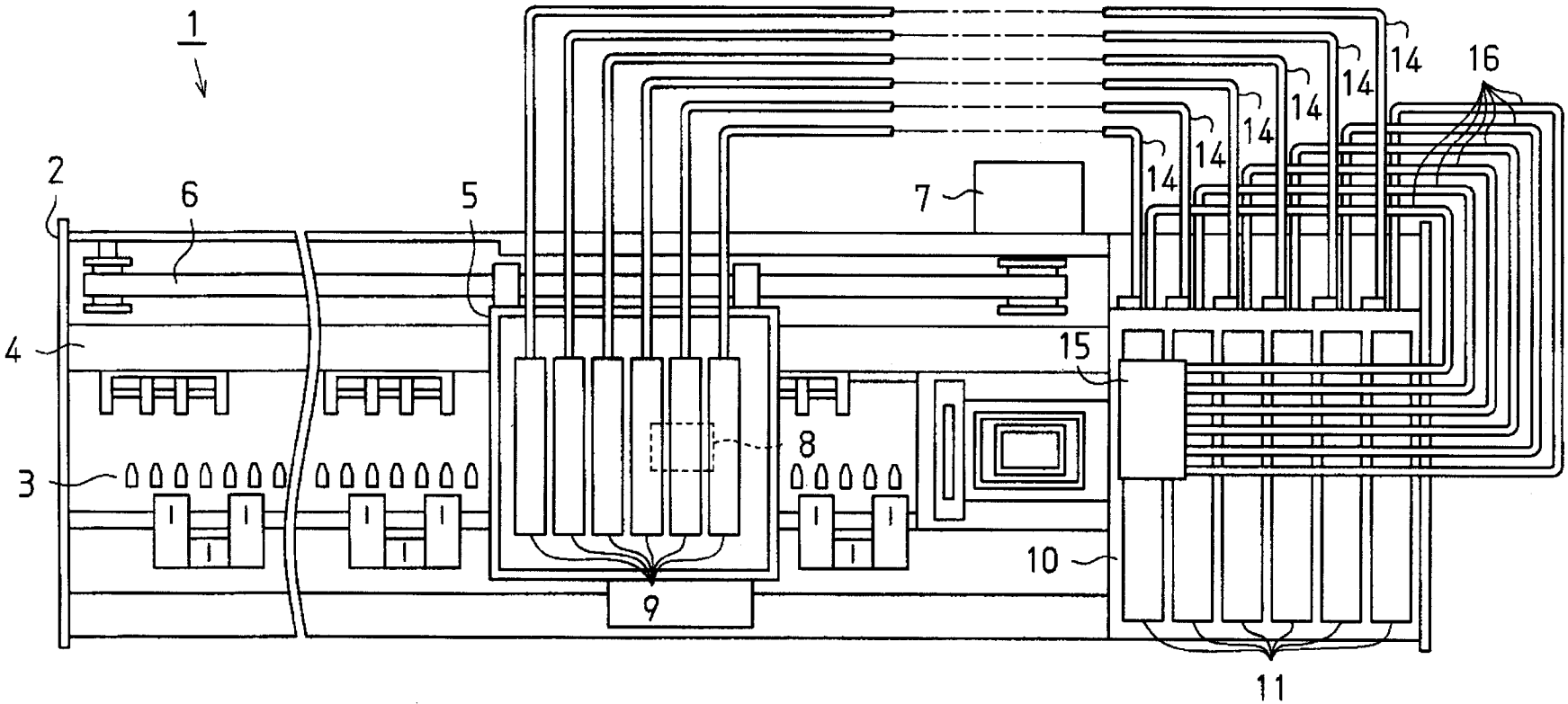
FIG. 1 is a plan view of a printer in this embodiment.

One embodiment of the invention will be described below with reference to FIGS. 1 to 8. FIG. 1 is a plan view explaining schematically an ink jet type recording apparatus (hereinafter referred to simply as a printer) used as a liquid jetting apparatus in the embodiment.

As shown in FIG. 1, a printer 1 includes a frame 2 which opens to the upside and is formed generally in the shape of a rectangular parallelepiped. For the frame 2, a paper feeding member (platen) 3 is provided, and paper is fed on this paper feeding member 3 by a not-shown paper feeding mechanism. Further, for the frame 2, a guide member 4 is provided in parallel to the paper feeding member 3 and inserted into a carriage 5 to support it so that the carriage 5 can move in an axial direction of the guide member 4. Further, this carriage 5 is coupled through a timing belt 6 to a carriage motor 7, and reciprocated along the guide member 4 by drive of the carriage motor 7.

On a surface of the carriage 5 opposed to the paper feeding member 3, a recording head 8 is mounted, which serves as a liquid ejection head. On the carriage 5, six valve units 9 which supply ink of liquid to the recording head 8 are mounted. The six valve units 9 are, in order to temporarily store ink therein, provided correspondingly to colors or types of ink (black ink, and color ink of cyan, light cyan, magenta, light magenta, and yellow).

On the lower surface of the recording head 8, not-shown nozzle openings are provided. By drive of a not-shown piezoelectric element, an ink droplet is ejected from the nozzle opening on paper that is a recording medium.

Figure 2:
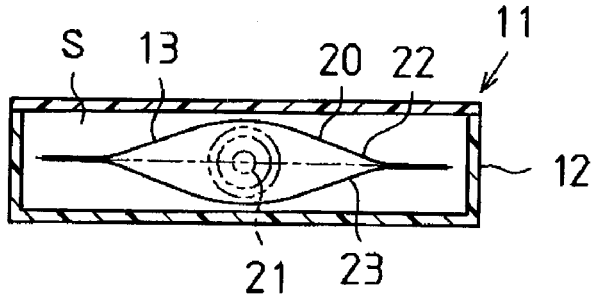
FIG. 2 is a sectional view of an ink cartridge provided for the printer.

At a right end of the frame 2, a cartridge holder 10 is formed. To this cartridge holder 10, six ink cartridges 11 as liquid containing members are detachably attached. Each of these ink cartridges 11, as shown in FIG. 2, comprises a case 12 of which the inside is in an airtight state, and an ink pack 13 housed into the case 12. In each ink pack 13, the black ink or each color ink is stored. These ink packs 13 and the valve units 9 are connected through flexible supply tubes 14.

Further, as shown in FIG. 1, for the printer 1, a pressure pump 15 is provided. This pressure pump 15 is connected through six air supply tubes 16 to the respective cases 12 of the respective ink cartridges 11. Accordingly, air pressurized by the pressure pump 15 is introduced through each air supply tube 16 into the case 12 of each ink cartridge 11, and introduced into a space S (refer to FIG. 2) formed between the case 12 and the ink pack 13.

Namely, when the pressure pump 15 is driven, the air is introduced into the case 12, and then the ink pack 13 is pressurized by the pressure air. By this press, ink stored in each ink pack 13 is pushed out from the ink pack 13 and supplied through each supply tube 14 to each valve unit 9.

Next, the ink pack 13 will be described with reference to FIGS. 2 to 4.

Figure 3:
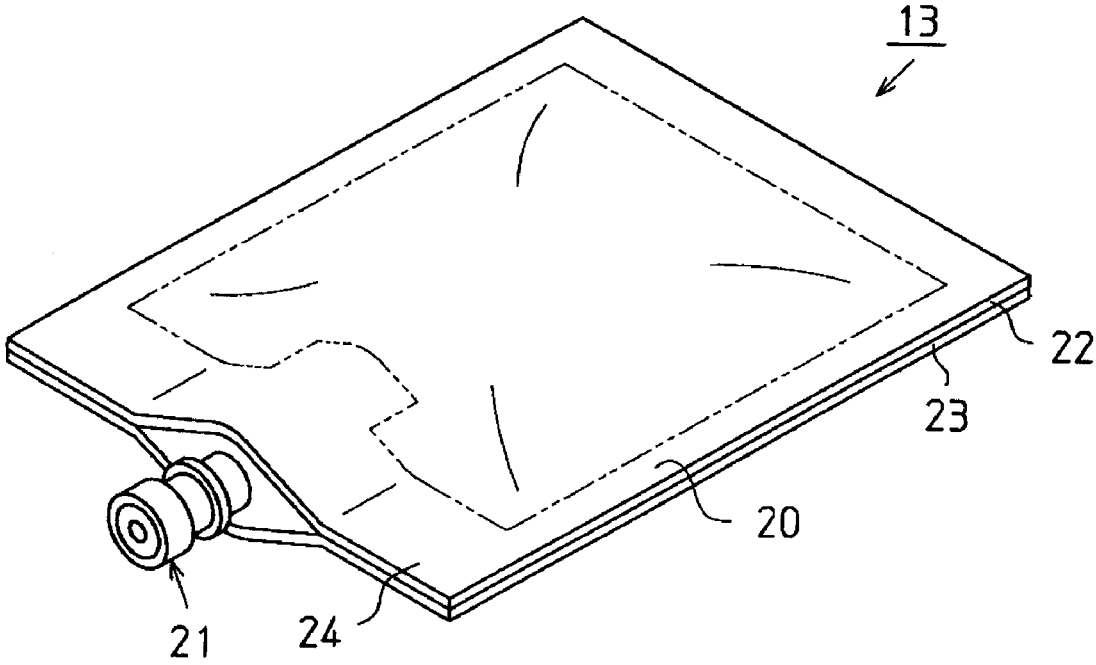
FIG. 3 is a perspective view of an ink pack provided for the ink cartridge.

As shown in FIG. 3, the ink pack 13 in the embodiment comprises a bag part 20 as a liquid containing part, and a outlet part 21 as a communication part. The bag part 20 comprises two rectangular film members 22 and 23 having the same size in the embodiment. These film members 22 and 23 are superimposed, and their four side edges are heat-welded, whereby the bag-shaped member is formed. Further, to a side 24 which is one of four sides of the bag part 20, the outlet part 21 is heat-welded in a state where it is put between the both film members 22 and 23. Hereby, the inside space of the bag part 20 is sealed, and ink has been filled into its inside space. Further, the film member 22, 23 is formed by evaporating a gas barrier layer such as aluminum over a thermoplastic resin layer such as a polyethylene film. The outlet part 21 is formed of resin that can be heat-welded to the thermoplastic resin layer of the film member 22, 23. Further, ink capacity of the ink pack 13 is 15 ml.

As described above, each film member 22, 23 has a thermoplastic resin layer and a gas barrier layer, and is formed in the shape of a rectangle. These film members 22 and 23 are superimposed so that their thermoplastic resin layers face each other, and their four side edges are heat-welded, whereby their film members are fixed to each other and bag-shaped. Further, to a side 24 which is one of four sides of the bag part 20, the outlet part 21 is heat-welded in a state where it is put between the film members 22 and 23. In the inside space of the bag part 20, each ink is contained.

Figure 5:
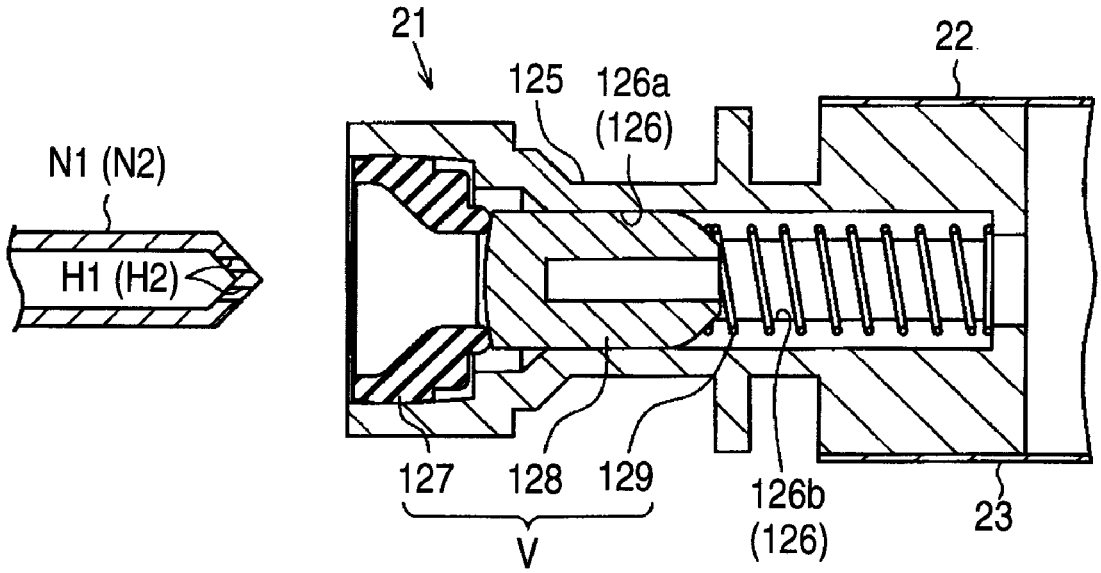
FIG. 5 is a sectional view of an outlet part of the ink pack.

Next, the outlet part 21 will be described with reference to FIGS. 5 and 6. The outlet part 21 includes a pipe body 125. The pipe body 125 has a outlet port 126 therein, and the inside of the ink pack 13 (bag part 20) is communicated with the outside through the outlet port 126. Further, the outlet port 126 comprises a center hole **126*a* and a communication groove 126*b* formed on the inner surface of the center hole 126*a***.

Further, inside the outlet port 126, a valve mechanism V is provided. This valve mechanism V includes a packing 127 that is composed of an elastic material such as rubber, and is a cylindrical seal member. The packing 127 includes in center a hole having an inner diameter that is a little smaller than an outer diameter of a hollow needle N1 connected to a leading end of the supply tube 14. This packing 127 is forced to the outlet side of the outlet port 126. Inside of the packing 127, a valve body 128 constituting the valve mechanism V is provided. Further, for the outlet port 126, a coil spring 129 constituting the valve mechanism V is provided so as to energize the valve body 128 to the packing 127 side. This coil spring 129, in case that power is not applied from the outside, presses the valve body 128 against the packing 127, and closes the hole of the packing 127 thereby to shut off flow of the fluid in the outlet port 126 as shown in FIG. 5. When the hollow needle N1 connected to the supply tube 14 is inserted through this packing 127 into the outlet part 21 as shown in FIG. 6, the hollow needle N1 presses the valve body 128 against the energizing power of the coil spring 129, so that the valve body 128 separates from the packing 127. At this time, the packing 127 is closely attached to the periphery of the hollow needle N1. In result, the fluid (ink) in the ink pack 13 passes through the communication groove **126*b* of the outlet port 126, and is supplied to a hole H1 provided for a leading end of the hollow needle N1. Then, the ink supplied from the hole H1 to the hollow needle N1 is supplied through the supply tube 14 to the recording head 8**.

Next, the method of inspecting the ink pack 13 for the presence or absence of leak (leak portion) will be described with reference to FIGS. 7 and 8. Firstly, the ink pack 13 is attached to a suction apparatus 131. The suction apparatus 131, as shown in FIG. 7, includes a suction pump P as a pressure variable means, and an air piping 132 is connected to the suction pump P. Further, for a leading end of the air piping 132, a hollow needle N2 that is a connection member (refer to FIG. 8) is provided. In the embodiment, the hollow needle N2 functions as a suction port. The hollow needle N2 has the same structure as the hollow needle N1 connected to the supply tube 14 shown in FIGS. 5 and 6. In the middle of this air piping 132, a valve 133 is provided.

Figure 6:
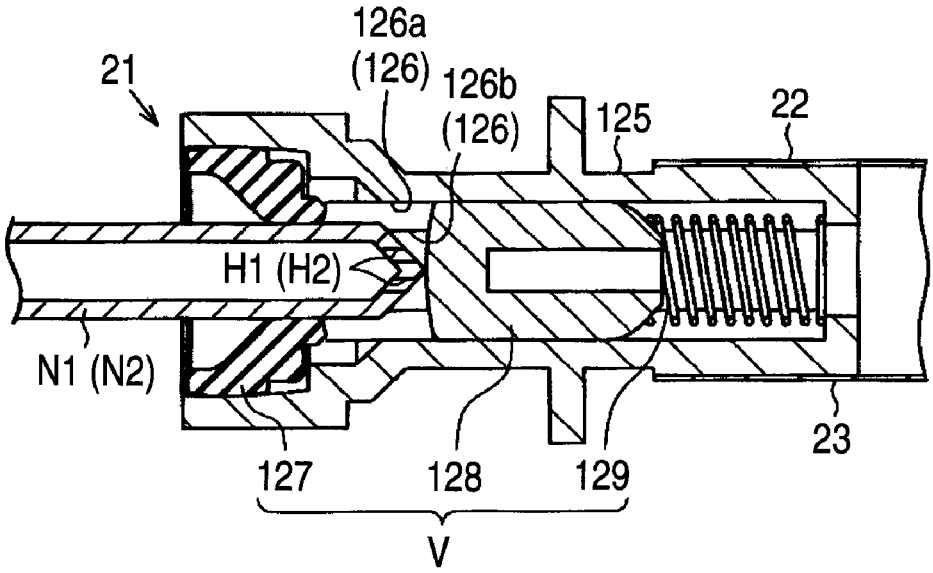
FIG. 6 is a sectional view of the outlet part of the ink pack.
Figure 7:
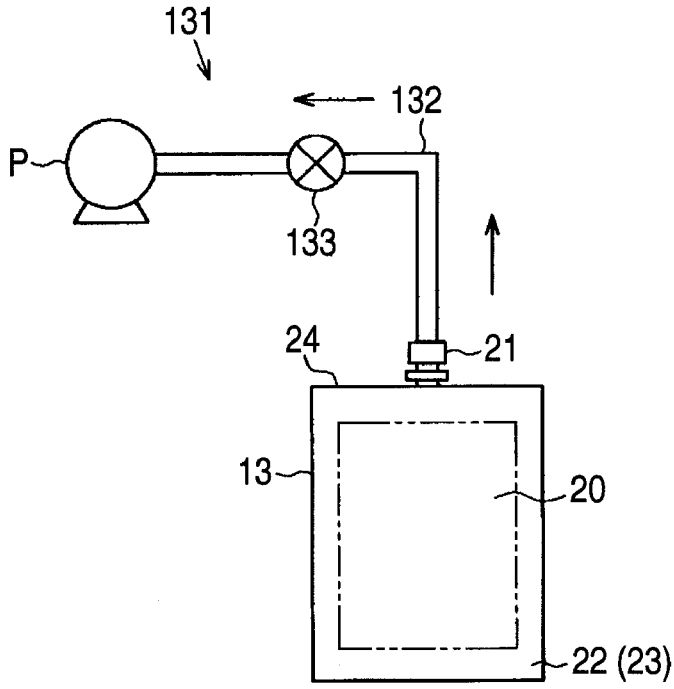
FIG. 7 is a diagram for explaining a method of inspecting the ink pack.

When the hollow needle N2 is inserted into the outlet part 21 of the ink pack 13, as shown in FIG. 6, the valve body 128 is pressed, and the outlet port 126 is put in the open state, so that the inside of the ink pack 13 is communicated with the air piping 132. At this time, since air has entered into the bag part 20 of the ink pack 13, the center parts of the both film members 22 and 23 of the ink pack 13 are not closely attached to each other but are separate from each other.

When the hollow needle N2 is inserted into the outlet part 21 and the ink pack 13 is attached to the suction apparatus 131, the valve 133 is put in the open state, and the suction pump P is driven for a depressurization step. Then, air in the ink pack 13 is sucked through the hole H2 of the hollow needle N2 and the air piping 132. At this time, as the air in the bag part 20 of the ink pack 13 is sucked, the inner surfaces of the film members 22 and 23 gradually come closer to each other, and the volume of the inside space of the bag part 20 becomes smaller. Namely, the internal pressure of the bag part 20 becomes smaller than the external pressure.

Figure 8:
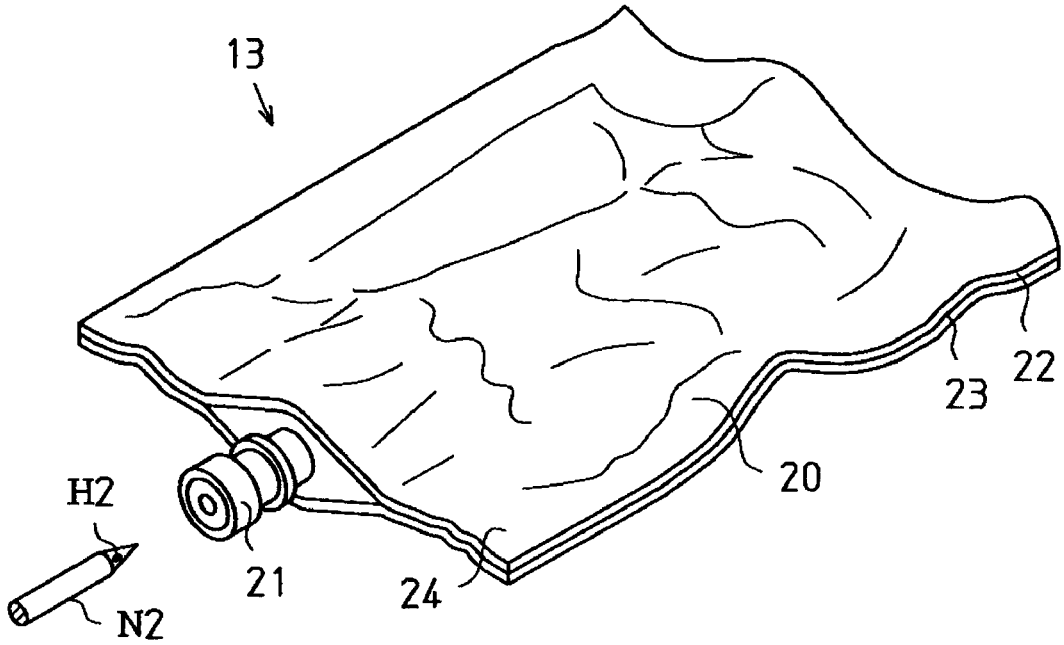
FIG. 8 is a perspective view of the ink pack in a depressurization step.

Further, when the suction pump P is driven, as shown in FIG. 8, the inner surfaces of the center portions of the both film members 22 and 23 are closely attached to each other, and the both film members 22 and 23 enters a yielding state. Thereafter, when the value measured by a not-shown pressure gauge comes to a predetermined pressure, the hollow needle N2 is pulled out from the outlet part 21. When the hollow needle N2 is pulled out, the valve body 128 is brought into pressure contact with the packing 127 by the energizing power of the coil spring 129, and the valve mechanism V is put in the close state. Hereby, the inside of the bag part 20 is sealed by the valve mechanism V. At this time, whether the both film members 22 and 23 are kept in the close attachment state is confirmed by appearance of the film members.

Further, for the predetermined time previously set, the ink pack 13 in the depressurization state is left. This predetermined time is, depending on the capacity or material of the ink pack 13, about several minutes to 12 hours. When the predetermined time passes, the operation proceeds to a confirmation step. Whether the appearance of the bag part 20 of the ink pack 13 is the appearance when the bag part has been depressurized (in the state where the both film members 22 and 23 are closely attached) is confirmed visually. In case that a hole or a poorly welded part does not exist in the bag part 20 or the outlet part 21, the pressure in the bag part 20 is nearly kept at the pressure depressurized in the depressurization step. Therefore, the appearance when the bag part has been depressurized is kept. Specifically, when the inner surfaces of the center portions of the film members 22 and 23 are closely attached, and the both film members 22 and 23 are in the yielding state, it is judged that the depressurization state is kept and the hole or the poorly welded part does not exist in the bag part 20 and the outlet part 21, so that the operation proceeds to an ink pouring step. The aforesaid predetermined time is time necessary for the appearance of the bag part 20 to change, in case that a leak portion exists in the ink pack 13, due to inflow of air from the leak portion into the ink pack 13 of which the inside is depressurized. Further, in the embodiment, the predetermined timed is time necessary to confirm the change of the appearance of the bag part 20 visually. Further, the predetermined time is obtained by an experiment.

On the contrary, in case that a minute hole or a poorly welded portion exists in the bag part 20 or the outlet part 21, air flows into the ink pack 13 through the hole or the poorly welded portion from the outside. In result, the air enters between the film members 22 and 23, and they separate from each other, so that the ink pack slightly swells as shown in FIG. 3. It is judged that such the ink pack 13 is not kept in the appearance under the depressurization (in the depressurization state), and the ink pack 13 is removed.

Next, each step of manufacturing the ink pack 13 will be described in detail with reference to FIG. 4. FIG. 4 is an explanatory diagram showing schematically an ink pouring apparatus 30 as a liquid filling apparatus which pours ink into the ink pack 13. The ink pouring apparatus 30 includes a main tank 31, a first degassing unit 32, a second degassing unit 33, and a mixing tank 34. The main tank 31 used as a liquid storing means stores ink therein. The first and second degassing units 32 and 33 as degassing means include respectively a vacuum pump and a hollow fiber bundle which are not shown, and function as units for degassing ink. The main tank 31 and the first degassing unit 32 are connected through a first ink piping 35 and a second ink piping 36 which constitute a second liquid supply passage. Further, in the middle of the first ink piping 35, an ink pressure feed pump P1 is provided. Between the first ink piping 35 and the second ink piping 36, a first check valve 38 is provided.

To the first degassing unit 32, a fourth ink piping 40 is connected through a third ink piping 39 constituting a first liquid supply passage. The third ink piping 39 is provided so as to branch from the fourth ink piping 40. In the middle of the third ink piping 39, a second check valve 41 and a third check valve 42 are provided. In the middle of the third ink piping 39, and between the second and third check valves 41 and 42, a first measuring pipe 43 as a first liquid pouring means is provided. The first measuring pipe 43 includes a cylinder 43*a* and a piston 43*b*. The capacity of this cylinder 43*a* is 5 ml (first predetermined amount), which is smaller than the ink capacity (15 ml) of the ink pack 13.

In the middle of the fourth ink piping 40, a fourth check valve 44 and a fifth check valve 45 are provided. Further, in the middle of the fourth ink piping 40, and between the fourth and fifth check valves 44 and 45, an ink pouring pipe 46 is connected so as to branch from the fourth ink piping 40. At a terminal of this ink pouring pipe 36, a not-shown hollow needle is provided.

Further, to the fourth ink piping 40, an air piping 47 is connected so as to branch from the fourth ink piping 40. In the middle of the air piping 47, an air check valve 48 is provided. To a terminal of the air piping 47, a suction pump P2 as a first suction means is connected. Further, to the fourth ink piping 40, a fifth ink piping 49 constituting the first supply passage and the mixing means is connected so as to branch from the fourth ink piping 40.

The fifth ink piping 49 is connected to the mixing tank 34 constituting the mixing means. In the middle of the fifth ink piping 49, a sixth check valve 50 and a seventh check valve 51 are provided. In the middle of the fifth ink piping 49, between the sixth and seventh check valves 50 and 51, a second measuring pipe 52 as a second suction means is provided. The second measuring pipe 52 includes a cylinder 52*a* and a piston 52*b*, and the capacity of the cylinder 52*a* is 5 ml. Further, in the middle of the fifth ink piping 49, and between the seventh check valve 51 and the mixing tank 34, a filter F is provided.

The mixing tank 34 is connected through the first ink piping 35 and a sixth ink piping 53 constituting the mixing means to the main tank 31. In the middle of the sixth ink piping 53, an eighth check valve 54 is provided. The mixing tank 34 is connected through a seventh ink piping 55 constituting the first liquid supply passage to the second degassing unit 33. The second degassing unit 33 is connected through an eighth ink piping 56 constituting the first liquid supply passage to the fourth ink piping 40. Namely, to the fourth ink piping 40, the third ink piping 39 and the eighth ink piping 56 are connected so as to branch from the fourth ink piping 40.

In the middle of the eighth ink piping 56, a ninth check valve 57 and a tenth check valve 58 are provided. Further, in the middle of the eighth ink piping 56, and between the ninth and tenth check valves 57 and 58, a third measuring pipe 59 as a second liquid pouring means is provided. The third measuring pipe 59 includes a cylinder 59*a* and a piston 59*b*, and the capacity of the cylinder 59*a* is 15 ml (second predetermined amount).

Next, using the thus constructed ink pouring apparatus 30, a method of filling ink into the ink pack 13 will be described.

Firstly, in the mixing tank 34, the ink previously supplied from the main tank 31 is stored. At this time, the first check valve 38 is put in a close state and the eighth check valve 54 is put in an open state, and the ink pressure feed pump P1 is driven. Then, the ink in the main tank 31 is supplied through the sixth ink piping 53 to the mixing tank 34.

Figure 4:
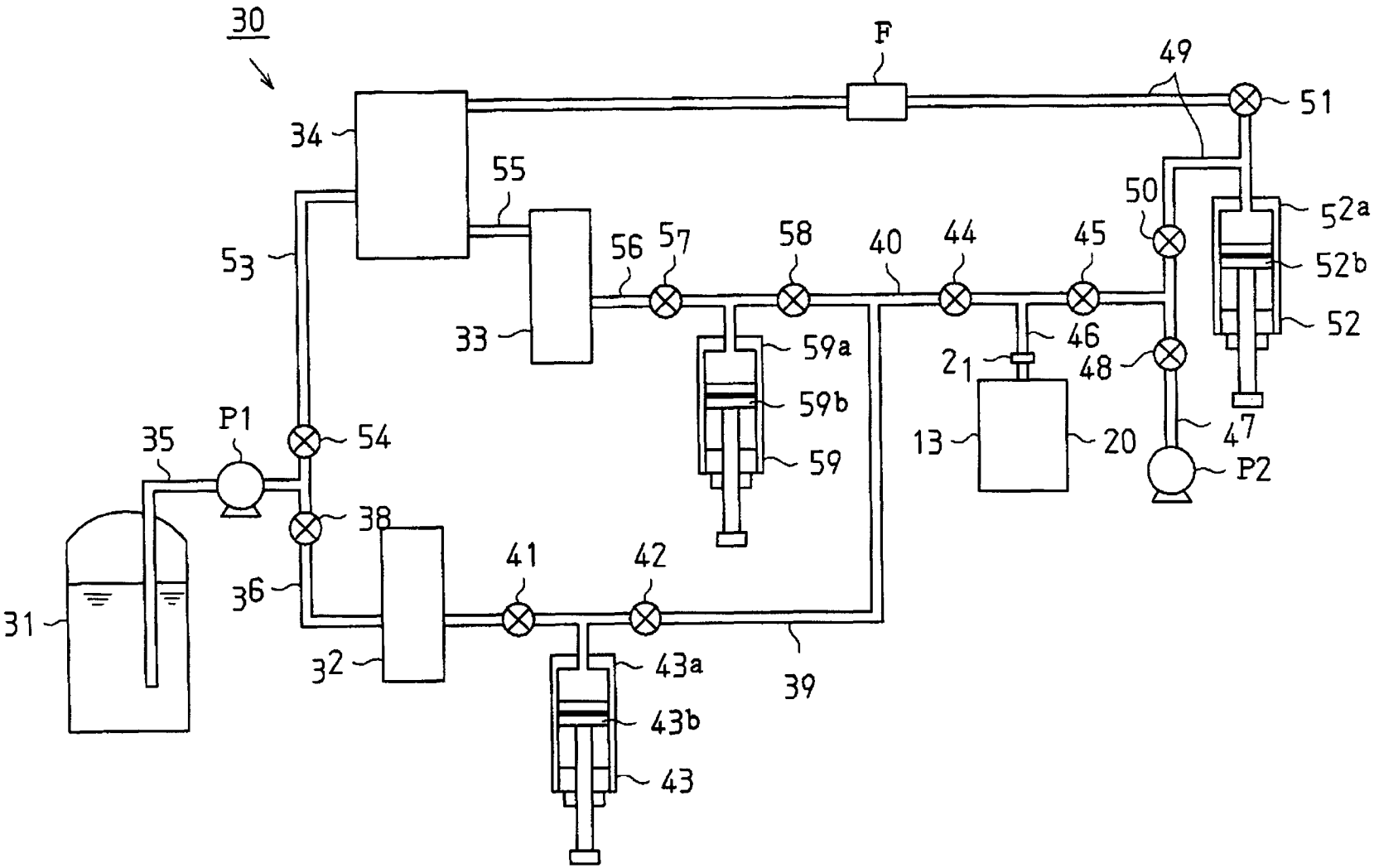
FIG. 4 is an explanatory view of an apparatus manufacturing the ink pack.

When ink is filled into the ink pack 13, firstly, as shown in FIG. 4, the ink pack 13 having no ink therein is attached to the ink pouring apparatus 30 by inserting the hollow needle of the ink pouring pipe 46 into the outlet part 21 of the ink pack 13. Next, in a depressurization step, the second check valve 41, the seventh check valve 51, and the ninth check valve 57 are put in the close state; the third check valve 42, the fourth check valve 44, the fifth check valve 45, the sixth check valve 50, the tenth check valve 58, and the air check valve 48 are put in the open state; and the suction pump P2 is driven. Then, the air piping 47, the fourth ink piping 40, the ink pouring pipe 46, the ink pack 13, the third ink piping 39, and the first measuring pipe 43 are depressurized in order. Further, the fifth ink piping 49 and the second measuring pipe 52 are depressurized in order. Further, the third measuring pipe 59 and the eighth ink piping 56 are also depressurized in order.

When depressurization proceeds to the predetermined pressure, the eighth check valve 54, the tenth check valve 58, and the fifth check valve 45 are put in the close state, and the first check valve 38, and the second to fourth check valves 41 to 44 are put in the open state.

When the ink pressure feed pump P1 is driven, ink stored in the main tank 31 is supplied through the first ink piping 35 and the second ink piping 36 to the first degassing unit 32 thereby to be degassed. Next, the degassed ink is supplied through the third ink piping 39 to the first measuring pipe 43. Sequentially, in a step of pouring a small amount of liquid, the second check valve 41 is put in the close state. Next, the piston 43*b* of the first measuring pipe 43 is pressed, and ink (cleaning ink) of 5 ml (first predetermined amount) is drawn as cleaning liquid. Then, the drawn ink of 5 ml is supplied through the third ink piping 39 and the fourth ink piping 40 into the ink pack 13. At this time, the amount of ink that is smaller than the ink capacity of 15 ml is poured into the ink pack 13, whereby the amount of ink entrapping the dust and air bubbles is made minimum. Further, by pouring the degassed ink, inclusion of the air bubbles in the ink pack 13 is prevented.

Next, when the ink pushed out from the first measuring pipe 43 is supplied into the ink pack 13, the process proceeds to a step of exhausting a small amount of liquid. The fourth check valve 44 and the air check valve 48 are put in the close state, and the fifth check valve 45 is put in the open state. Further, the piston 52*b* of the second measuring pipe 52 is pulled. Then, the ink (cleaning ink) in the ink pack 13 is sucked through the depressurized fifth ink piping 49 into the similarly depressurized second measuring pipe 52. At this time, together with the ink, a little dust and air existing in the ink pack 13 are also moved to the second measuring pipe 52, so that the degassed and clean levels in the ink pack 13 improve.

Next, in a mixing step, the sixth check valve 50 is put into the close state, and the seventh check valve 51 is put in the open state. The piston 52*b* of the second measuring pipe 52 is pressed, and the ink (cleaning ink) of 5 ml contained in the second measuring pipe 52 is moved through the fifth ink piping 49 to the mixing tank 34. At this time, the exhausted ink is fed through the filter F to the mixing tank 34. Therefore, the dust and air existing in the ink are removed by the filter F, and the ink is supplied to the mixing tank 34 in a state where the degassed and clean levels are improved. Since the predetermined of ink previously supplied from the main tank 31 is stored in the mixing tank 34, the 5 ml ink exhausted from the ink pack 13 is mixed with the ink supplied from the main tank 31. Namely, the ink used in order to heighten the degassed and clean levels is not thrown away but is reused.

Next, in a pouring step, the tenth check valve 58 is put in the close state, and the ninth check valve 57 is put in the open state. Further, the piston 59*b* of the third measuring pipe 59 is pulled. Then, the ink (mixed liquid) supplied from the mixing tank 34 and degassed by the second degassing unit 33 is supplied to the third measuring pipe 59. At this time, in the third measuring pipe 59, the ink of 15 ml is contained. When the ink is poured into the third measuring pipe 59, the ninth check valve 57 and the fifth check valve 45 are put in the close state, the tenth check valve 58 and the fourth check valve 44 are put in the open state, the piston 59*b* of the third measuring pipe 59 is pressed, and all the ink of 15 ml (second predetermined amount) in the cylinder 59*a* is moved into the ink pack 13. Lastly, the hollow needle is pulled out from the outlet part 21 of the ink pack 13, and the ink filling work into the ink pack 13 is completed.

According to the embodiment, the following effects can be obtained.

(1) In the embodiment, the inside of the bag part 20 of the ink pack 13 is depressurized by the suction pump P provided for the suction apparatus 131 to the predetermined pressure, so that the inner surfaces of the center portions of the film members 22 and 23 are closely attached to each other, and put in the yielding state. After the predetermined time, whether the film members 22 and 23 keep the appearance in the depressurization (depressurization state) is confirmed visually, whereby the presence or absence of leak is inspected. Therefore, without taking labor using the leak tester, by only depressurizing the inside of the bag part 20, the presence or absence of leak of the ink pack 13 can be easily confirmed.

(2) In the embodiment, by depressurizing the inside of the bag part 20 of the ink pack 13, difference is made between the internal pressure of the bag part 20 and the external pressure, whereby the film members 22 and 23 are put in the yielding state. Therefore, it is possible to prevent the welded portion of the bag part 20 from being broken by increasing the internal pressure of the bag part 20.

(3) In the embodiment, the cleaning ink is poured into the ink pack 13 by the first measuring pipe 43, and the ink poured into the ink pack 13 is sucked by the second measuring pipe 52. Therefore, dust and gas existing into the ink pack 13 can be exhausted together with the ink, so that the degassed and clean levels in the ink pack 13 before the ink is filled can be improved. In case where the inside of the ink pack 13 is depressurized through the air piping 47 by the suction pump P2 before the cleaning ink is poured into the ink pack 13, dust and gas existing into the ink pack 13 can be substantively exhausted by the depressurizing step, and a little dust and gas still existing into the ink pack 13 can be exhausted together with the ink by the pouring step. Accordingly, the degassed and clean levels in the ink pack 13 before the ink is filled can be further improved.

Further, the sucked cleaning ink is fed out to the mixing tank 34 which stores ink previously supplied from the main tank 31, and it is mixed with the stored ink. Furthermore, the mixed ink is poured into the ink pack 13 by the third measuring pipe 59. Therefore, the ink used in order to heighten the degassed and clean levels is not thrown away but can be reused in order to be filled into the liquid containing member. Therefore, the ink that is high in degassed and clean levels can be filled into the ink pack 13, and the ink can be used efficiently in the manufacturing process of the liquid containing member.

(4) In the embodiment, the mixing tank 34 is connected to the second measuring pipe 52, the main tank 31, and the third measuring pipe 59. The ink supplied from the main tank 31 and the ink (cleaning ink) supplied from the second measuring pipe 52 are mixed into the mixing tank 34, and the mixed ink is supplied from the mixing tank 34 to the third measuring pipe 59. Therefore, the ink entrapping the dust and gas in the ink pack 13 is not returned to the main tank 31 for the purpose of reuse, but is drawn into the mixing tank 34, and used as ink to be immediately filled into the ink pack 13. Therefore, since the ink is not circulated in the apparatus many times and not used repeatedly, the liquid that is always new and has quality assurance can be filled into the ink pack 13.

(5) In the embodiment, in the middle of the fifth ink piping 49, and between the second measuring pipe 52 and the mixing tank 34, the filter F is provided. The cleaning ink entrapping the dust, which is fed out from the second measuring pipe 52, is filtered by the filter F, and fed out into the mixing tank 34. Accordingly, the ink fed out from the second measuring pipe 52 is mixed with the ink in the mixing tank 34 in a state where the degassed and clean levels are improved. Therefore, the ink having high quality can be poured into the ink pack 13.

(6) In the embodiment, the amount of ink (cleaning ink) poured from the first measuring pipe 43 into the ink pack 13 for the purpose of cleaning in the ink pack 13 is set smaller than the amount of ink poured into the ink pack 13 from the third measuring pipe 59 for the purpose of ink filling. Namely, the ink amount for improving the degassed and clean levels in the ink pack 13 is smaller than the ink filling amount of the ink pack 13. Therefore, since the amount of ink entrapping the dust and air is made minimum, it is possible to prevent quality of the ink filled into the ink pack 13 from lowering.

In the embodiment, the main tank 31 is connected to the first degassing unit 32, and the ink is supplied from this first degassing unit 32 to the first measuring pipe 43. Therefore, since the ink previously degassed can be poured into the ink pack 13, inclusion of the air bubbles in the ink pack 13 can be prevented. Further, since the ink is previously degassed before being poured, it is possible to prevent the degassed level of the ink exhausted from the ink pack 13 from lowering remarkably. Therefore, regarding whole of the ink circulating in the apparatus, lowering of the degassed level of the ink can be prevented.

(7) In the embodiment, the mixing tank 34 is connected to the second degassing unit 33, and the ink is supplied from this second degassing unit 33 to the third measuring pipe 59. Therefore, since the ink fed out from the mixing tank 34, after being degassed, can be poured into the ink pack 13, the ink having higher degassed level can be filled into the ink pack 13.

Further, the embodiment may be changed as follows:

In the embodiment, each ink cartridge 11 comprises each case 12, and the ink pack 13 housed in each case 12. This ink cartridge may comprise one case and plural ink packs housed in the case. Further, the number of the ink cartridges 11 is not limited to six, but may be appropriately changed according to the kind of ink used in the printer 1. Further, the ink cartridge 11 may be used in a state where the ink pack 13 is not housed in the case.

In the embodiment, though the ink pack 13 is formed by sticking two films to each other, the invention is not limited to this. For example, the bag part 20 of the ink pack 13 may be composed of a bag-shaped film. Further, the bag part 20 may be so constructed that three or more films are stuck to one another in the shape of a bag.

In the embodiment, though the ink pack is formed of the flexible film, this may be an ink cartridge in which the inside of a resin case is partitioned by flexible films. Namely, the ink containing member can be applied to an ink cartridge having an ink containing part provided with flexible portions that deform by difference of pressure between the internal pressure and the external pressure.

In the embodiment, after the ink pack 13 has been depressurized, it is left for the predetermined time, and the presence or absence of change of the appearance of the ink pack 13 is confirmed visually, whereby the presence or absence of leak is confirmed. Otherwise, using a monitor as a detecting means for detecting an external shape of the bag part 20, and a control unit which is connected to the monitor and processes image data picked up by the monitor, the image data picked up by the monitor is processed, whereby the change of shape may be confirmed. Hereby, the inspection can be performed more efficiently.

In the embodiment, by depressurizing the inside of the bag part 20 of the ink pack 13, the both film members 22 and 23 are put in the yielding state. However, gas may be pressure-fed into the bag part 20 thereby to put the bag part in a pressurization state and cause the film members 22 and 23 to yield. Namely, the internal pressure of the bag part 20 may be made higher than the external pressure. Hereby, since the bag part 20 of which the inside previously put in the pressurization state can be inspected for the presence or absence of leak, the fragile portion can be also inspected. In this case, it is desirable that the film members are caused to yield by such pressure that break at the welded portion is not produced.

In the embodiment, in the middle of the seventh ink piping 55 as a flowing path or the eighth ink piping 56, a filter may be provided. Hereby, ink having higher clean level can be filled into the ink pack 13.

In the embodiment, though the amount (first predetermined amount) of ink poured into the ink pack 13 by the first measuring pipe 43 is 5 ml, it may be appropriately changed to another amount. Namely, the ink amount used in order to exhaust the dust and the air bubbles in the ink pack 13 may be smaller than 5 ml, larger than 5 ml, or smaller than 15 ml. Further, the aforesaid ink amount (first predetermined amount) may be 15 ml or more.

In the embodiment, each ink cartridge 11 comprises each case 12, and the ink pack 13 housed in each case 12. This ink cartridge may comprise one case and plural ink packs housed in the case. Further, the number of the ink pack 13 is not limited to six, but may be appropriately changed according to the kind of ink used in the printer 1.

In the embodiment, the ink pack is used as the liquid containing member. However, the liquid containing member may so constructed that a film is stuck onto an opening part of a concave case having a communication part, and liquid is contained into the sealed concave part; and the liquid containing member is not limited to the ink pack composed of the bag-shaped film member. Namely, as long as the liquid containing member is provided with a liquid containing part which can contain liquid, and a communication part which communicates the liquid containing part with the outside, it may have any structure.

In the embodiment, though the ink pack 13 is formed by sticking two films to each other, the invention is not limited to this. For example, the bag part 20 of the ink pack 13 may be composed of a bag-shaped film. Further, the bag part 20 may be so constructed that three or more films are stuck to one another in the shape of a bag.

In the embodiment, when the ink is filled into the ink pack 13, the ink pack previously sealed is used. Additionally, an ink pack before the opening is sealed may be used. At this case, the opening of the ink pack, till the pouring step ends, is temporarily sealed by a seal means such as a grasping member.

In the embodiment, the printer 1 uses the ink supplying method of pressurizing the ink pack 13 by feeding pressure air into the case 12 and supplying ink to the supply tube 14. However, the invention is not limited to this. For example, the ink cartridge 11 may be arranged above the recording head 8 to press-feed the ink to the recording head 8 by the gravity.

In the embodiment, the method of manufacturing the ink pack 13 as described with reference to FIG. 4 can be performed after the method of inspecting the ink pack 13 as described with reference to FIGS. 7 and 8 is executed. In this case, the depressurization step included in the method of manufacturing the ink pack 13 as described with reference to FIG. 4 may be omitted because the ink pack 13 confirmed by the method of inspecting the ink pack 13 as described with reference to FIGS. 7 and 8 has been already put in the depressurization state.

In the embodiment, any one of the method of inspecting the ink pack 13 as described with reference to FIGS. 7 and 8 and the method of manufacturing the ink pack 13 as described with reference to FIG. 4 can be applied not only a case in which a brand-new ink pack is manufactured but also a case in which a recycled ink pack is manufactured using a used ink pack collected from a user.

In the embodiment, though as the liquid jet apparatus, the printer 1 ejecting the ink has been described, other liquid jet apparatuses may be used. For example, a printing apparatus including a facsimile or a copier; a liquid jet apparatus which jets liquid such as electrode material or color material used in manufacture of a liquid crystal display, an EL display, or a surface light emitting display; a liquid jet apparatus which jets a bioorganic matter used in manufacture of a biochip; and a sample jet apparatus as a precise pipette may be used. Further, the fluid (liquid) is not also limited to the ink but the invention may be applied to other fluid (liquid). Further, the liquid containing member may be used in a state where it is mounted on another apparatus than the liquid jet apparatus to be used.

What is claimed is:

1. A method of inspecting a liquid containing member having a liquid containing part which is formed at least in part by a flexible member and adapted to contain liquid therein, and a communication part that communicates an inside of the liquid containing part with an outside thereof, the method comprising:

yielding the flexible member of the liquid containing part to be a yielding state by setting an internal pressure of the liquid containing part to a predetermined pressure that is different from an external pressure of the liquid containing part before liquid is introduced into the liquid containing part;

picking up image data of an external shape of the liquid containing part by a monitor; and processing the image data to confirm change of the external shape of the liquid containing part by a control unit connected to the monitor;

wherein it is judged that a leak portion exists in the liquid containing member in a case that the external shape of the liquid containing part is changed.

2. The method according to claim 1, wherein the internal pressure of the liquid containing part is set to be lower than the external pressure.

3. The method of claim 1, wherein:

the communication part of the liquid containing member has a valve mechanism which opens when a connection member of pressure variable means is inserted into the communication part, and closes when the connection member is pulled out from the communication part; and when the internal pressure of the liquid containing part is set to the predetermined pressure, the connection member is inserted into the communication part to communicate the pressure variable means with the inside of the liquid containing part, and when the liquid containing part is left for a predetermined time period, the connection member is pulled out from the communication part.

* * * * *